US005697555A

United States Patent [19]

Robinson

[11] Patent Number: 5,697,555

[45] Date of Patent: Dec. 16, 1997

[54] APPARATUS FOR DISPERSING LIQUID IN DROPLETS

[76] Inventor: Arthur Robinson, 1754 Pagehurst Ave., Mississauga, Ontario, Canada, L4X 1Y2

[21] Appl. No.: 503,663

[22] Filed: Jul. 18, 1995

[51] Int. Cl.[6] ..... B05B 3/10

[52] U.S. Cl. ..... 239/219; 239/226; 239/263.1

[58] Field of Search ..... 239/44, 145, 214, 239/219, 225.1, 226, 263.1, 7

[56] References Cited

U.S. PATENT DOCUMENTS

| | | | |
|---|---|---|---|
| 409,978 | 8/1889 | Kisinger | 239/214 |
| 940,103 | 11/1909 | Feld | 239/219 |
| 1,601,097 | 9/1926 | Alanson . | |
| 2,126,959 | 8/1938 | Heuer . | |
| 3,176,474 | 4/1965 | Abbot . | |
| 4,303,617 | 12/1981 | Bryson . | |
| 4,780,253 | 10/1988 | Fukuhara et al. . | |
| 4,978,069 | 12/1990 | Andersson et al. | 239/214 X |
| 5,154,893 | 10/1992 | Nakade . | |
| 5,246,167 | 9/1993 | Mahon . | |
| 5,281,401 | 1/1994 | Bryson, Sr. . | |
| 5,382,410 | 1/1995 | Peltier . | |

FOREIGN PATENT DOCUMENTS

| | | | |
|---|---|---|---|
| 2275877 | 9/1994 | United Kingdom | 239/219 |

*Primary Examiner*—Lesley D. Morris
*Attorney, Agent, or Firm*—Ridout & Maybee

[57] ABSTRACT

An apparatus for controlled dispersion of a fluid as droplets or as a fine mist or vapor. The apparatus comprises a dispersion head for dispersing liquid and a motor for rotating the dispersion head. The dispersion head comprises a bundle of fibres having ends contacting the liquid and tips for dispersing the liquid. The fibres are arranged to produce capillary action in addition to the centrifugal force for moving liquid to the tips for dispersion. The fibres may be formed from stainless steel or glass and have a hollow core. The apparatus is suitable for dispersing liquids with corrosive properties.

8 Claims, 4 Drawing Sheets

APPARATUS FOR DISPERSING LIQUID IN DROPLETS

FIELD OF THE INVENTION

This invention relates to apparatus for dispersing a liquid, and more particularly to a device which utilizes a fiber bundle to disperse liquid.

BACKGROUND OF THE INVENTION

Liquid dispersing devices are known in the art. Such a device is taught by Heuer in U.S. Pat. No. 2,126,959. Heuer discloses a moistening device comprising a moisture disc connected to a moisture supply tank for supplying the disc with moisture. The moisture disc taught by Heuer comprises a wire screen frame and an absorbent fabric which is attached to a rotatable shaft. The shaft is hollow and has a pipe connection to the supply tank so that water flows from the tank to the disc. In operation, the disc is rotated by the shaft and the rotation causes the moisture to be distributed throughout the disc and released into the surrounding air.

While Heuer teaches a device which is suitable for releasing moisture into the surrounding air through a rotating action, the Heuer device is not well-suited for dispersing liquid in vapor form or as droplets with a controllable size. Furthermore, the moisture disc taught by Heuer is not suitable for dispersing certain liquids, such as oil or corrosive fluids.

In U.S. Pat. No. 5,246,167, Mahon discloses a droplet application device for applying concentrated chemicals, such as pesticides and herbicides. The device taught by Mahon comprises a disc shaped device having radially extending fibers. The disc shaped device is rotatable about a central axis so that upon rotation, liquid is dispensed by the fibers. The density of the fibers increases from the top surface to the bottom surface of the device so that the bottom is substantially impervious to the liquid. The liquid droplets are formed by the centrifugal force generated by the rotation of the disc and the fibers help prevent the disc from being overloaded with liquid. While the Mahon device is suitable for dispensing liquids such as herbicides or pesticides, the device is not well-suited for producing a fine mist or vapor or liquid droplets with a controllable size.

Accordingly, there is a need for liquid dispersing apparatus for controlled dispersion of a liquid as a fine mist or vapor or as larger droplets. There is also a need for a liquid dispersing apparatus suitable for dispersing fluids which may be corrosive.

BRIEF SUMMARY OF THE INVENTION

The present invention provides an apparatus for controlled dispersion of a fluid as droplets or as fine mist or vapor. The apparatus according to the invention is also suitable for dispersing liquids with corrosive properties, such as certain oils.

In a first aspect, the present invention provides an apparatus for dispersing a liquid comprising: (a) a dispersion head for dispersing the liquid; (b) a motor connected to said dispersion head for rotating said dispersion head; and (c) said dispersion head comprising a plurality of fibers having ends for contacting the liquid and tips for dispersing the liquid and said fibers being arranged to produce capillary action for moving liquid from said ends to said respective tip ends for dispersion by said rotation.

BRIEF DESCRIPTION OF THE DRAWINGS

Reference will now be made, by way of example, to the accompanying drawings which show a preferred embodiment of the present invention, and in which.

DETAILED DESCRIPTION OF THE PREFERRED EMBODIMENT

Figure 1:
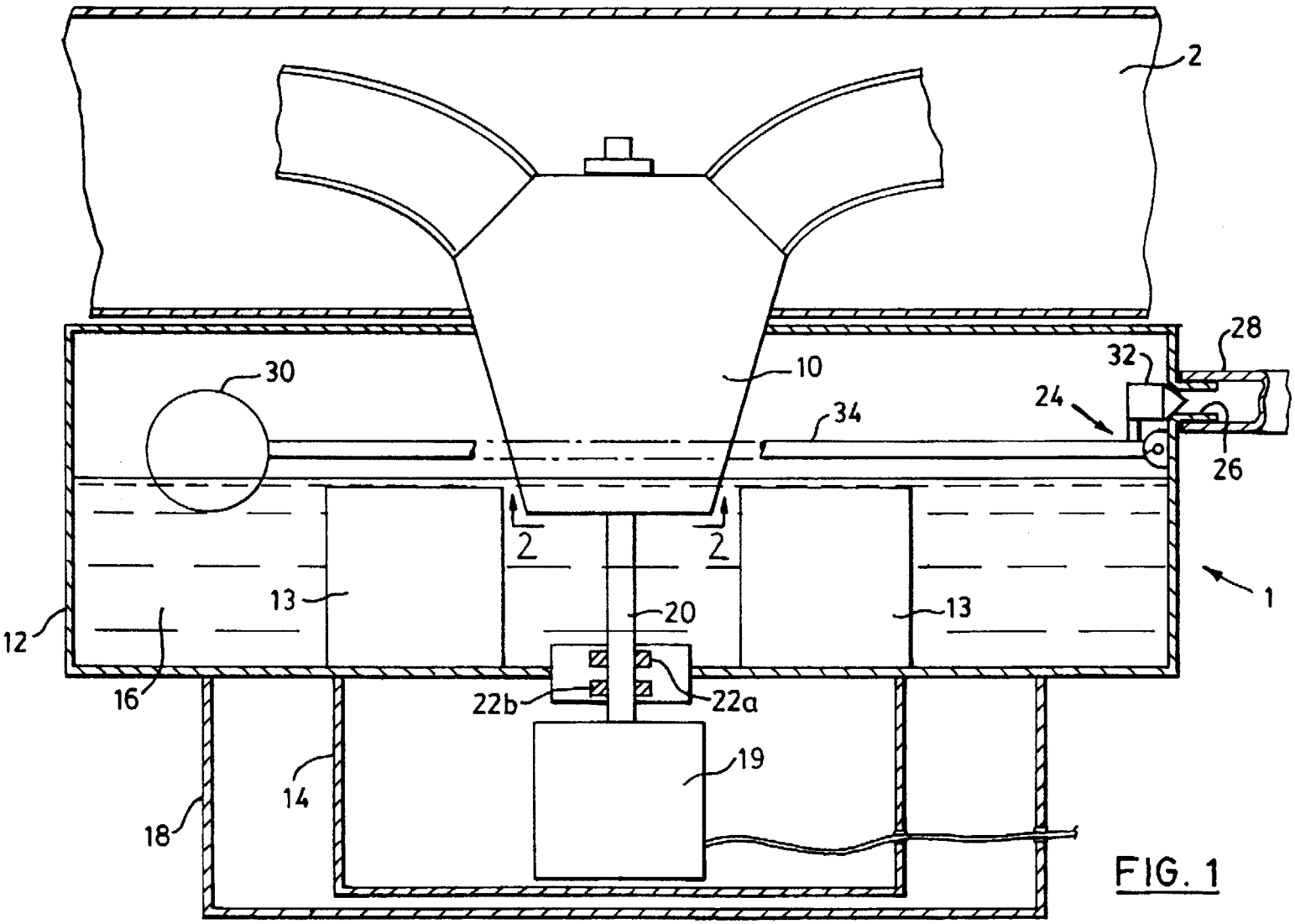
FIG. 1 shows a liquid dispersing device according to the present invention.

Reference is first made to FIG. 1 which shows an apparatus for dispersing liquid according to the present invention. The liquid dispersing device 1 comprises a liquid dispersing head 10, a reservoir tank 12 and a motor drive unit 14.

As shown in FIG. 1, the liquid dispersing device 1 is coupled to a HVAC (Heating, Ventilation, Air Conditioning) Duct 2, with the dispersing head 10 extending into the duct 2. The dispersing device 1 disperses liquid into the duct 2 as a fine mist or vapor or in the form of droplets with a controllable size. In another embodiment, the liquid dispersing device 1 comprises a free-standing arrangement positioned in a room, for example, and the duct 2 is replaced by a cover (not shown) with suitable openings for releasing the vapor or droplets.

Referring to FIG. 1, the reservoir tank 12 holds a liquid 16 which is to be dispersed. The reservoir tank 12 is mounted on a base 18 which houses the motor drive unit 14. The motor drive unit 14 comprises a conventional motor 19, e.g. 110 Volts AC and may include a speed control unit (not shown). The dispersing head 10 is mounted on a shaft 20 which is connected to and driven by the motor 19. Shaft seals **22*a*,22*b* are provided to seal the motor drive unit 14 from the reservoir 12**.

The reservoir tank 12 is provided with a float and valve mechanism 24 or other suitable device to control the supply of liquid 16 to the tank 12 through a supply inlet 26. The supply inlet 26 is connected to a liquid supply (not shown) through a pipe 28. The float and valve mechanism 24 shown in FIG. 1 comprises a float 30 and needle 32 arrangement. The float 30 is attached to one end of a shaft 34. The needle 32 is attached to the other end of the shaft 34 which is pivotally connected to the wall of the tank 12. The edges of the inlet 26 are bevelled to permit the needle 32 to pivot as the shaft 34 is raised or lowered. When there is sufficient liquid 16 in the tank 12, the needle 32 registers with the inlet 26. As the level of the liquid 16 drops in the tank 12, the float 30 and shaft 34 will pivot downwards causing the needle 32 to open the inlet 26 and additional liquid to enter the reservoir 12. Other suitable automatic or manual liquid supply devices may be provided as will be within the understanding of those skilled in the art.

As shown in FIG. 1, the reservoir tank 12 includes baffle plates 13. The baffle plates 13 help control the turbulence in the liquid 16 which results from the rotation of the dispersing head 10, particularly around the submerged end of the dispersing head 10.

Figure 5:
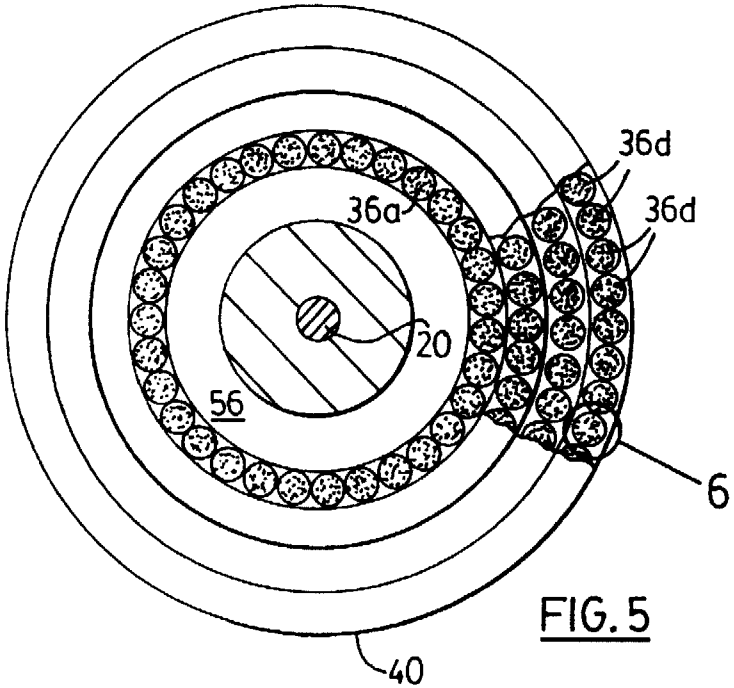
FIG. 5 is a sectional view taken across line 5—5 for the dispersing head of FIG. 2.
Figure 6:
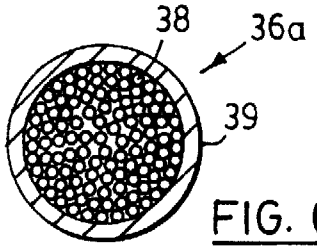
FIG. 6 is a cross-sectional view of a fiber bundle for the dispersing head of FIG. 5.
Figure 4:
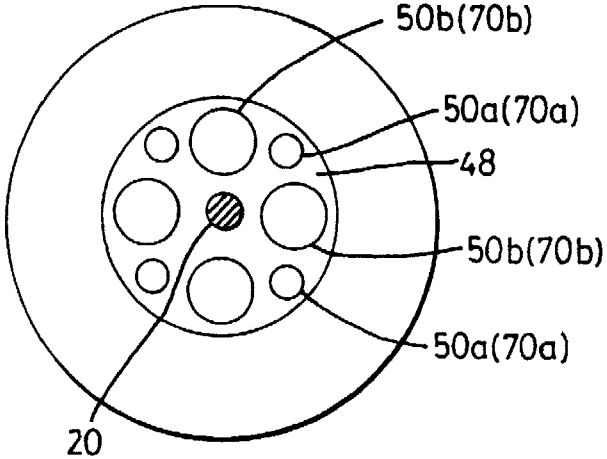
FIG. 4 is a view of the bottom of the dispersing head of FIG. 3.

Reference is next made to FIG. 2 and FIGS. 4 to 6 which show the dispersing head 10 in more detail. The dispersing head 10 includes one or more fiber bundles 36*a*, 36*b*, 36*c*, 36*d*, 36*e*, and 36*f*. Each fiber bundle 36 comprises a bundle of fibers or strands 38 encased in a sheath 39 or other suitable sleeve as shown in FIGS. 5 and 6 with exposed tip ends 41. The individual fibers 38 are fitted together in the bundle 36 in order to allow for capillary action of the liquid 16 through spaces between the fibers 38. The arrangement of the fibers 38 in separate sheaths 39 also assists in the dispersion, flow and control of the liquid 16. Each sheath 39 is preferably made from an impervious material, such as polypropylene. Preferably the individual fibers 38 have a diameter in the range of about 0.005 to 0.02 inches and are made from glass, stainless steel wire, plastic (corrosion resistant), polypropylene or other suitable material. The fibers 38 may have a hollow core to augment collection and transportation of liquid 16 to the tip ends 41.

Figure 2:
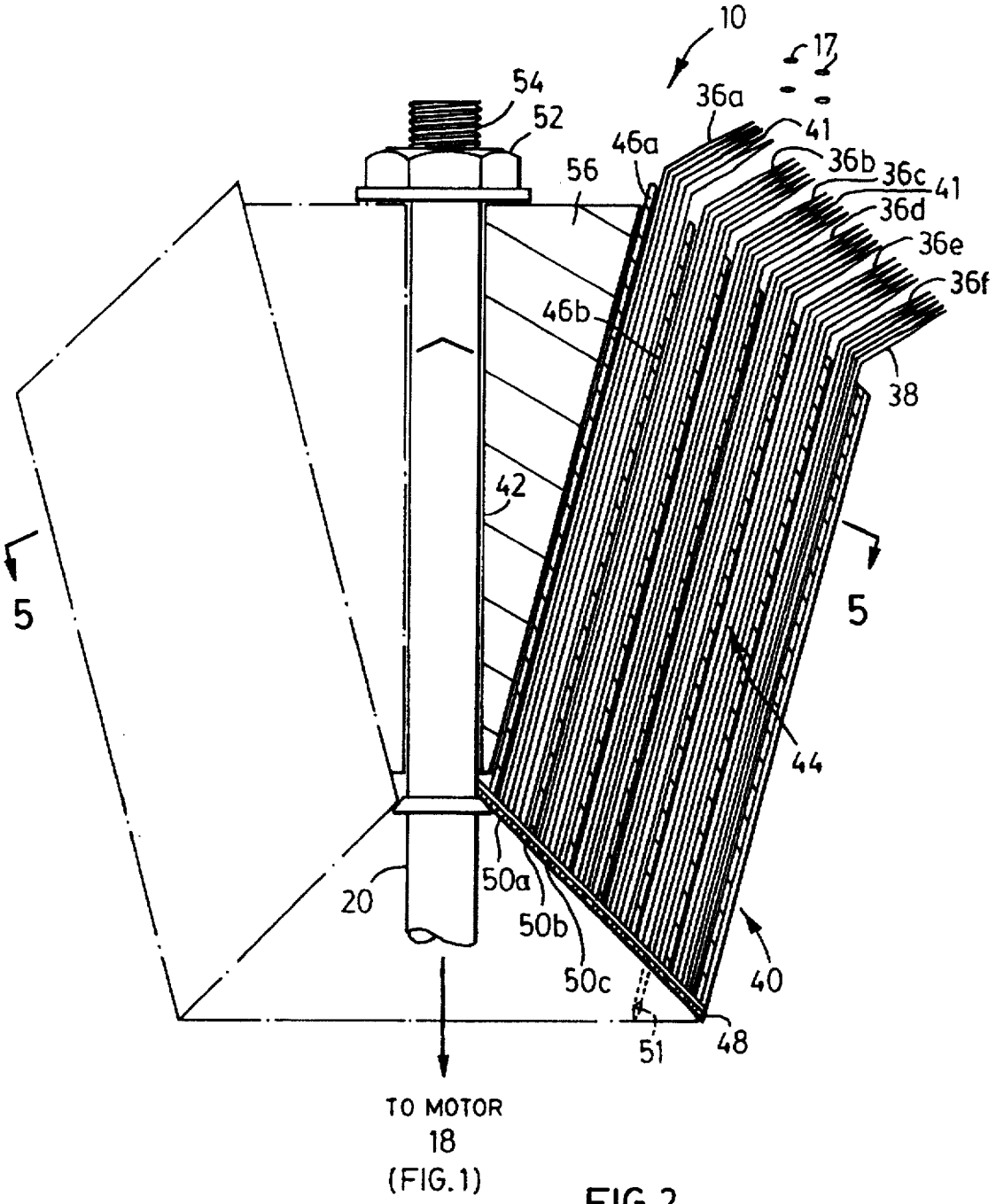
FIG. 2 is a sectional view of the dispersing head for the device of FIG. 1 taken along line 2—2.

As shown in FIG. 2, the fiber bundles 36 are contained inside a support holder 40. The support holder 40 comprises a sleeve 42 which slides onto the shaft 20 and a compartment 44 for holding the fiber bundles 36. The support holder 40 is made from a non-permeable material, for example stainless steel or a high density polypropylene. The fiber bundles 36 are separated by inner bundle supports 46*a*,46*b* which are also made from a non-permeable material, for example, stainless steel or polypropylene. The support holder 40 includes a bottom plate 48 shown in FIGS. 2 and 4. The bottom plate 48 includes openings 50*a*,50*b*. The openings 50*a*,50*b* register with the fiber bundles 36*a*,36*b* and provide the ends of the fibers 38 with contact to the liquid 16. To facilitate the collection of liquid 16, the ends of the fibers 38 contacting the liquid may have a scoop 51 formed in the lower extremity of the fiber 38 as shown in broken outline in FIG. 3. The scoop 51 allows the fiber 38 to pick up liquid through the rotation of the head 10 as well as through the capillary action. If the fiber 38 is hollow, then the collection of liquid 16 is enhanced further.

The support holder 40 is secured to the shaft 20 by a nut 52 which screws to a threaded portion 54 on the shaft 20.

As shown in FIG. 2, the support holder 40 has a conical shape and an angular spacer 56 is positioned between the fiber bundle 36*a* and the shaft 20. As will be described below, the angular orientation of the fiber bundles 36 improves the efficiency of the head 10 in dispersing the liquid 16. The fiber bundles 36 can be oriented at an angle in the range of 85° to 10° to the horizontal.

Figure 7:
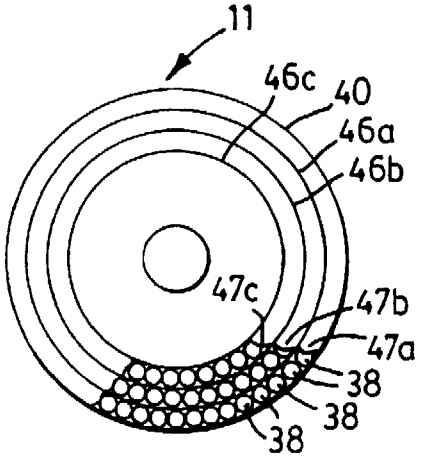
FIG. 7 is a sectional view of another embodiment of the dispersing head of FIG. 3.

Reference is made to FIG. 7 which shows another embodiment of a dispersing head 11. For the dispersing head 11 shown in FIG. 7, the fibers 38 are arranged without a sheath in concentric rings 47*a*,47*b*,47*c* around the shaft 20. The concentric rings 47 are defined by the inner supports 46*a*,46*b*,46*c* and the support holder 40 (on the outside). The fibers 38 are arranged as a single row (as shown) or in multiple rows within the space defined by adjacent inner supports 46.

In operation, the dispersing head 10 is rotated by the motor 19 and controlled dispersion of the liquid 16 is accomplished through the lifting of the liquid 16 from the reservoir tank 12 in the spaces between the fibers 38 in the bundles 36 by the combination of capillary action and centrifugal force. As the liquid 16 is drawn from the reservoir 12 by the capillary action, the centrifugal force generated by the rotation of the dispersing head 10 moves the liquid 16 to the tips 39 of the fibers 38. The liquid 16 collects at the tips of the fibers 38 until the kinetic energy of the liquid 16 becomes greater than the cohesive force, and the liquid 16 is dispersed from the fibers 38 as droplets 17. Liquid 16 will also vaporize before propagating to tips 39 as air passes over the fibers 38 and the amount of vaporization will depend on the speed of rotation of the head 10 and/or the speed of the air passing across the fibers 38.

Figure 3:
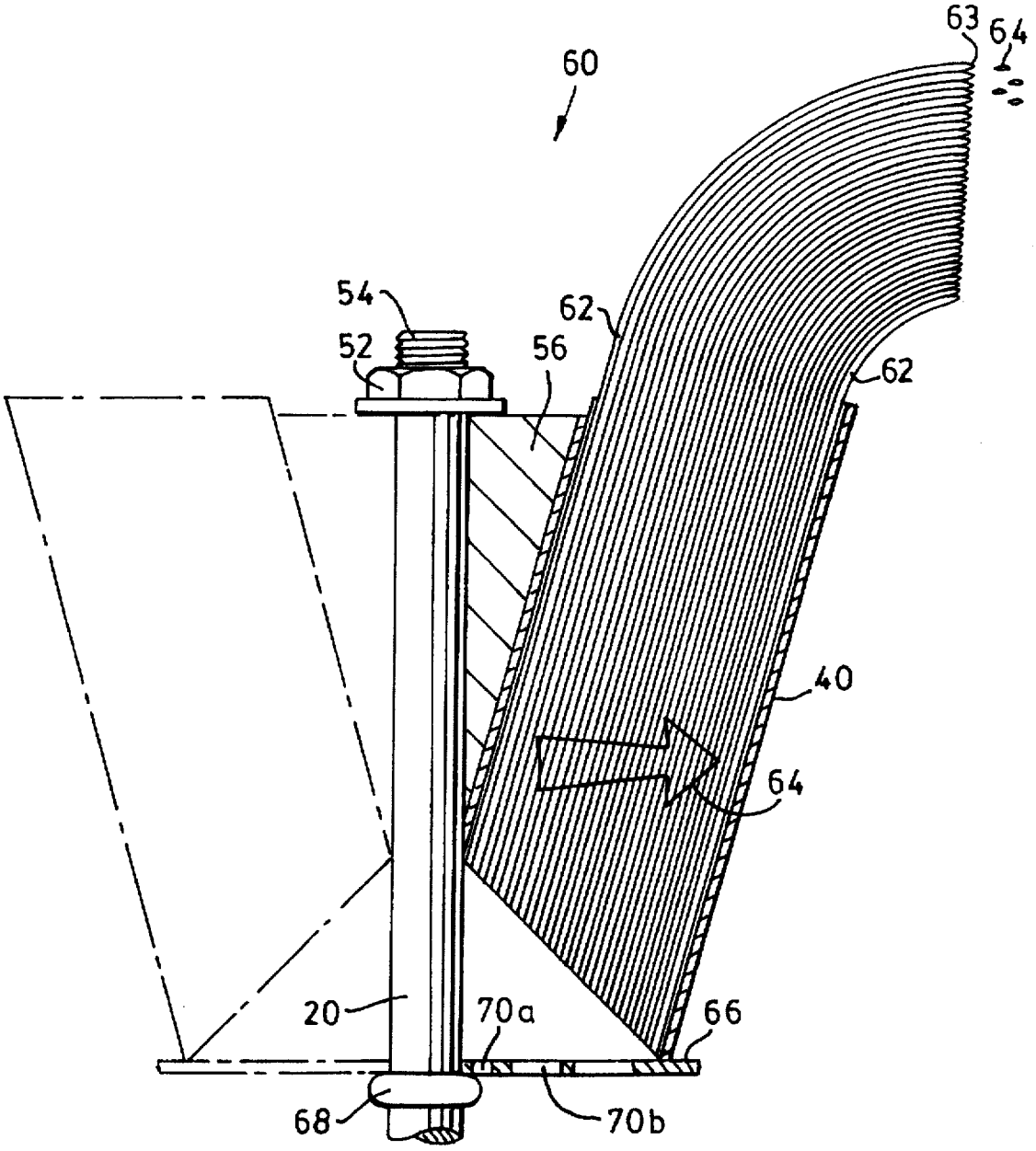
FIG. 3 is a sectional view of another embodiment of a dispersing head according to the present invention.

To facilitate the propagation of the liquid 16 to the tips of the fibers 38, the fiber bundles 36 are preferably oriented at an angle as shown in FIGS. 2 and 3. A certain amount of the liquid 16 will propagate horizontally across the fibers 38 in the bundle 36 and the angled orientation of the inner bundle support walls 46 helps deflect this liquid 16 up towards to the tips 41 of the fibers 38.

The size and shape of the tip end 41 of the fiber 38 influence the ability of the liquid 16 (or droplets 17) to remain attached to the tips of the fibers 38. The fiber 38 shown in FIG. 2 with a pointed tip 41 will produce smaller size droplets 17 than a square or blunt tip 63 (FIG. 3). The size of the droplet 17 is also dependent on the surface tension of the liquid 16 being dispersed.

Reference is next made to FIG. 3, which shows another embodiment of a dispersing head 60 according to the present invention. Like reference numerals indicate like elements.

For the dispersing head 60 shown in FIG. 3, fibers 62 are arranged in the compartment 44 as a continuous body, i.e. the fibers 38 are not encased in sheaths 39 (FIG. 2). Because there is a likelihood of horizontal propagation of the liquid 16 across the fibers 62 as indicated by arrow 64, the fibers 62 are preferably arranged at an angle as defined by the support wall 40 and angular spacer 56 in order to deflect the liquid 16 to the tips 63 of the fibers 62 for dispersion as droplets 64. The dispersing head 60 includes a bottom plate 66 attached at a right angle to the shaft 20 by a stopper 68. The bottom plate 66 includes a number of openings 70*a*,70*b* for the liquid 16 to enter and contact the lower ends of the fibers 62.

According to the invention, the dispersion of the liquid 16 is controlled through the following variables.

The speed of rotation of the dispersing head 10 (or 60) determines the size of the droplet 17 which is expelled from the fiber 38. A speed in the range of 3000 rpm to 4000 rpm is suitable for most applications. The faster the speed of rotation the smaller the droplet 17. The droplet size $D_s$ can be approximated using the following expression:

$$D_s = \frac{1}{f(\,)T \times V_1 \times S_T}$$

where, $D_s$=droplet size in μm

T=kinetic energy $S_T$=constant for surface tension, where water has a constant equal to one $V_1=2\pi d/60$, and d is diameter of the head 10

The number of fibers 38 in the dispersing head 10 determines the amount of liquid 16 which is dispersed. Since each fiber 38 or strand is capable of delivering a certain amount of liquid 16, the amount of liquid 16 dispersed by the head 10 depends on the number of fibers 38 in the head 10.

The space between the fibers 38 determines the amount of liquid 16 held between the fibers 38 and affects the amount of liquid 16 dispersed in two respects. First, the internal resistance to the flow of the liquid 16 is inversely proportional to the space between the fibers 38. Secondly, the capillary action of the fibers 38 is directly dependent on the spacing between the fibers 38. By selecting the proper spacing, the dispersing head 10 can be "self-priming" through this capillary action, eliminating the need for a pump to start the flow of the liquid 16 up the fibers 38.

The viscosity of the liquid 16 affects the movement up the fibers 38 to the tips 41, i.e. the capillary action. For viscous liquids, it is preferable to increase the rotation speed for the dispersing head 10.

In one application, the dispersing device 1 according to the present invention is used to treat "sick building syndrome". The device 1 disperses a liquid having anti-bacterial, anti-fungicidal, and anti-microbial properties into the air duct or air space of a building. A suitable liquid with such properties comprises a combination of tea tree oil and ethanol. The dispersing device 1 is also suitable for dispersing various essential oils, such as jasmine, ylang-ylang, rosewood, neroli, tangerine, cedar, pine, spruce, balsam, and peppermint.

The present invention may be embodied in other specific forms without departing from the spirit or essential characteristics thereof. Therefore, the presently discussed embodiments are considered to be illustrative and not restrictive, the scope of the invention being indicated by the appended claims rather than the foregoing description, and all changes which come within the meaning and range of equivalency of the claims are therefore intended to be embraced therein.

What is claimed is:

1. An apparatus for dispersing a liquid comprising:

(a) a dispersion head for dispersing the liquid;

(b) a motor connected to said dispersion head for rotating said dispersion head;

(c) said dispersion head comprising a plurality of fibers having ends for contacting the liquid and tips for dispersing the liquid and said fibers being arranged to produce capillary action for moving liquid from said ends to said respective tip ends for dispersion by said rotation; and (d) said fibers comprising a plurality of bundles, each bundle having a plurality of fibers encased in a sheath.

2. The apparatus as claimed in claim 1, wherein said sheath is formed from an impervious material.

3. The apparatus as claimed in claim 1 or 2, wherein said bundles are arranged in one or more concentric circles.

4. An apparatus for dispersing a liquid comprising:

(a) a dispersion head for dispersing the liquid;

(b) a motor connected to said dispersion head for rotating said dispersion head;

(c) said dispersion head comprising a plurality of fibers having ends for contacting the liquid and tips for dispersing the liquid and said fibers being arranged to produce capillary action for moving liquid from said ends to said respective tip ends for dispersion by said rotation, and including; means for orienting said fibers at an angle; and (d) said dispersion head including a bottom plate for submersion in the liquid and having a plurality of openings for allowing said liquid to contact the ends of said fibers.

5. An apparatus for dispersing a liquid comprising:

(a) a dispersion head for dispersing the liquid;

(b) a motor connected to said dispersion head for rotating said dispersion head;

(c) said dispersion head comprising a plurality of fibers having ends for contacting the liquid and tips for dispersing the liquid and said fibers being arranged to produce capillary action for moving liquid for said ends to said respective tip ends for dispersion by said rotation; and (d) said fibers being arranged in concentric rings separated by inner supports.

6. The apparatus as claimed in claim 5, wherein each of said concentric rings comprises a single row of fibers.

7. The apparatus as claimed in claim 5, wherein each of said concentric rings comprises two or more rows of fibers.

8. The apparatus as claimed in claim 6 or 7, wherein said fibers have a hollow core for receiving some of said liquid.

* * * * *